US007686612B1

(12) United States Patent
Buteau

(10) Patent No.: US 7,686,612 B1
(45) Date of Patent: Mar. 30, 2010

(54) ROTARY KILN SEAL

(76) Inventor: Barry Buteau, 3017 Patoutville Rd., Jeanerette, LA (US) 70544

( * ) Notice: Subject to any disclaimer, the term of this patent is extended or adjusted under 35 U.S.C. 154(b) by 434 days.

(21) Appl. No.: 11/648,010

(22) Filed: Dec. 28, 2006

(51) Int. Cl.
*F27B 7/24* (2006.01)

(52) U.S. Cl. ..... 432/115; 277/903

(58) Field of Classification Search ..... 432/115; 277/903, 358, 390, 391, 590
See application file for complete search history.

(56) References Cited

U.S. PATENT DOCUMENTS 3,575,397 A 4/1971 McDowell et al.
3,700,220 A * 10/1972 Talago ..... 432/32
4,050,702 A 9/1977 Del Matto
4,342,555 A * 8/1982 Bohanszky ..... 432/115
4,405,137 A 9/1983 Webb
4,502,702 A 3/1985 Nixon, Jr.
4,554,748 A * 11/1985 Nixon, Jr. ..... 34/242
4,953,480 A 9/1990 Collins, Jr.
4,961,588 A * 10/1990 Brienza ..... 277/545
5,263,724 A * 11/1993 Hansen et al. ..... 277/377
5,483,753 A * 1/1996 Boivin et al. ..... 34/242
5,704,301 A 1/1998 Blasiole
5,769,428 A 6/1998 Rypalia
6,589,049 B1 * 7/2003 Sutton et al. ..... 432/115

* cited by examiner

*Primary Examiner*—Gregory A Wilson
(74) *Attorney, Agent, or Firm*—Robert N. Montgomery

(57) ABSTRACT

An improved, heat resistant seal assembly for deformation compensation of rotary kilns having a plurality of integrated seal segments interconnected to form a biased expandable constrictive ring around a rotating drum, the seal segments being attached to a portion of a stationary in-feed or out-feed hopper of a kiln assembly, each seal segment assembly having a plurality of friction wear pads, the seal assembly forming a long lasting expanding and contracting sealing ring that prevents the buildup of material particles and escaping heat and gas from degrading the biasing components or interfering with kiln deformation compensation.

17 Claims, 6 Drawing Sheets

ROTARY KILN SEAL

1. FIELD OF THE INVENTION

This invention relates generally to radial seals for rotary kilns, dryers, and coolers and more particularly to radial seals that provide total sealing ability between the stationary in-feed or out-feed housings of such kilns and the large diameter rotating drums and even more particularly to sealing systems for rotary kilns with radial run-out deformation, axial growth due to high thermal expansion, and deformation resulting from accumulations of viscous materials and for hazardous waste and carbon black kilns where gas and heat leakage or atmospheric intrusion is not acceptable.

2. GENERAL BACKGROUND

Rotary kilns generally are defined as an inclined, large diameter, elongated rotating drum having a stationary in-feed hopper and exhaust stack at the upper end and a stationary out-feed materials collection hopper at the lower, or fired, end. Seals are generally provided at each end for the obvious reasons of maintaining heat, gas, and material particles within the kiln.

Known rotary kiln seals routinely utilize some form of biased heat and abrasive resistant material to bridge the gap between the rotary drum and the stationary in-feed and out-feed housings. Since the rotary drum radius constantly varies relative to its longitudinal centerline due to non-uniform heat within the drum, material weight, etc., the diameter of the drum is distorted. Allowing the drum seals to be displaced as necessary and still maintain a good seal is essential in order to compensate for such distortion. Further, since the seals are often subjected to high heat, friction, and abrasion, the seal material is usually a composite of materials.

A great many of the rotary kiln seal systems are not intended to provide a complete 100% seal. Such seals that allow some leakage of gas and material particles do so in order to allow for some atmospheric intrusion to improve combustion. It has been found that leakage of heat and material particle build-up around and between the seal segments prevents or disrupts any distortion compensation capabilities that may be used. The economics involved in cleaning and replacing seal components is a major factor in kiln maintenance. Therefore, there is a need for a rotary kiln distortion compensation seal arrangement that provides long life and is effective against high heat and material particle buildup.

3. SUMMARY OF THE INVENTION

An improved heat resistant seal assembly for rotary kilns having a plurality of integrated interactive seal segment assemblies interconnected to each other to form a biased expandable ring. The stationary seal segment assemblies are each independently attached in a pivotal and translatable manner to a portion of the stationary in-feed and/or out-feed hoppers of the kiln assembly; each segment assembly having a plurality of friction wear pads clamped thereto forming a composite of materials in frictional contact with the rotating drum. The seal assembly forms a long-lasting expanding and contracting sealing ring assembly that prevents the buildup of material particles and escaping heat and gas from degrading the biasing components or interfering with kiln deformation compensation.

It is an object of the invention to provide a self-adjusting, high heat gas seal for rotary kilns that also prevents material particle leakage and has long life and uniform wear.

Another object of the invention is to reduce wear of the sealing elements and preserve the integrity of the biasing elements by protecting them with a metal, high heat wear barrier and an expansion joint cover.

Still another object of the invention is to reduce wear by providing carbon or graphite pads to reduce friction between the sealing elements and the rotating drum.

A further object is to provide a seal assembly having segment assemblies that may be rapidly replaced as units with minimum effort without disturbing adjacent elements.

4. BRIEF DESCRIPTION OF THF DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THF PREFERRED EMBODIMENT

Figure 1:
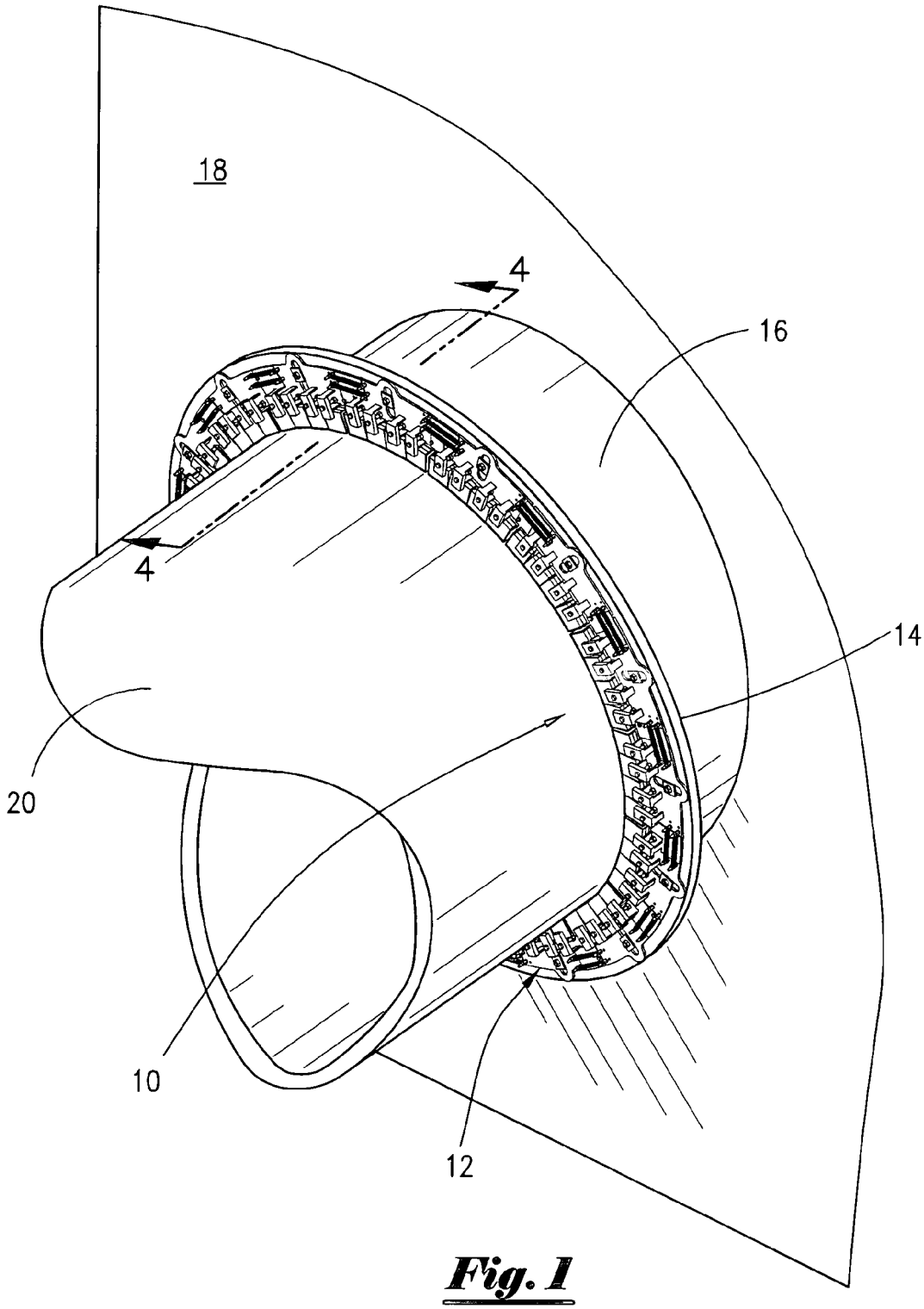
FIG. 1 is an isometric view of the preferred embodiment of the kiln seal assembly attached to an upper or input end of a stationary hopper/exhaust housing in contact with the rotary drum.

The improved rotary kiln seal assembly 10, as first seen in FIG. 1, is a plurality of interacting sealing segments that form an expanding and contracting sealing ring that prevents the buildup of material particles between the sealing elements and further prevents escaping heat and gas from degrading the biasing components and thus interfering with kiln deformation compensation.

As shown in FIG. 1, the plurality of segment assemblies 12 forming the seal assembly 10 is systematically arranged in a circular manner by attachment to a flange member 14 extending perpendicularly to a stationary tubular member 16, extending from the in-feed/exhaust housing 18. The tubular rotary drum 20 extends into and rotates within the stationary tubular member 16, with portions of the seal assembly 10 in contact with the external diametrical surface of the rotary drum 20. However, other similar arrangements may be utilized to accommodate existing stationary in-feed housings and for out-feed housings (not shown) located at the fired lower or discharge end of the rotary drum 20. It is fully understood by those knowledgeable in the art how the rotary drum is supported and rotated.

Figure 2:
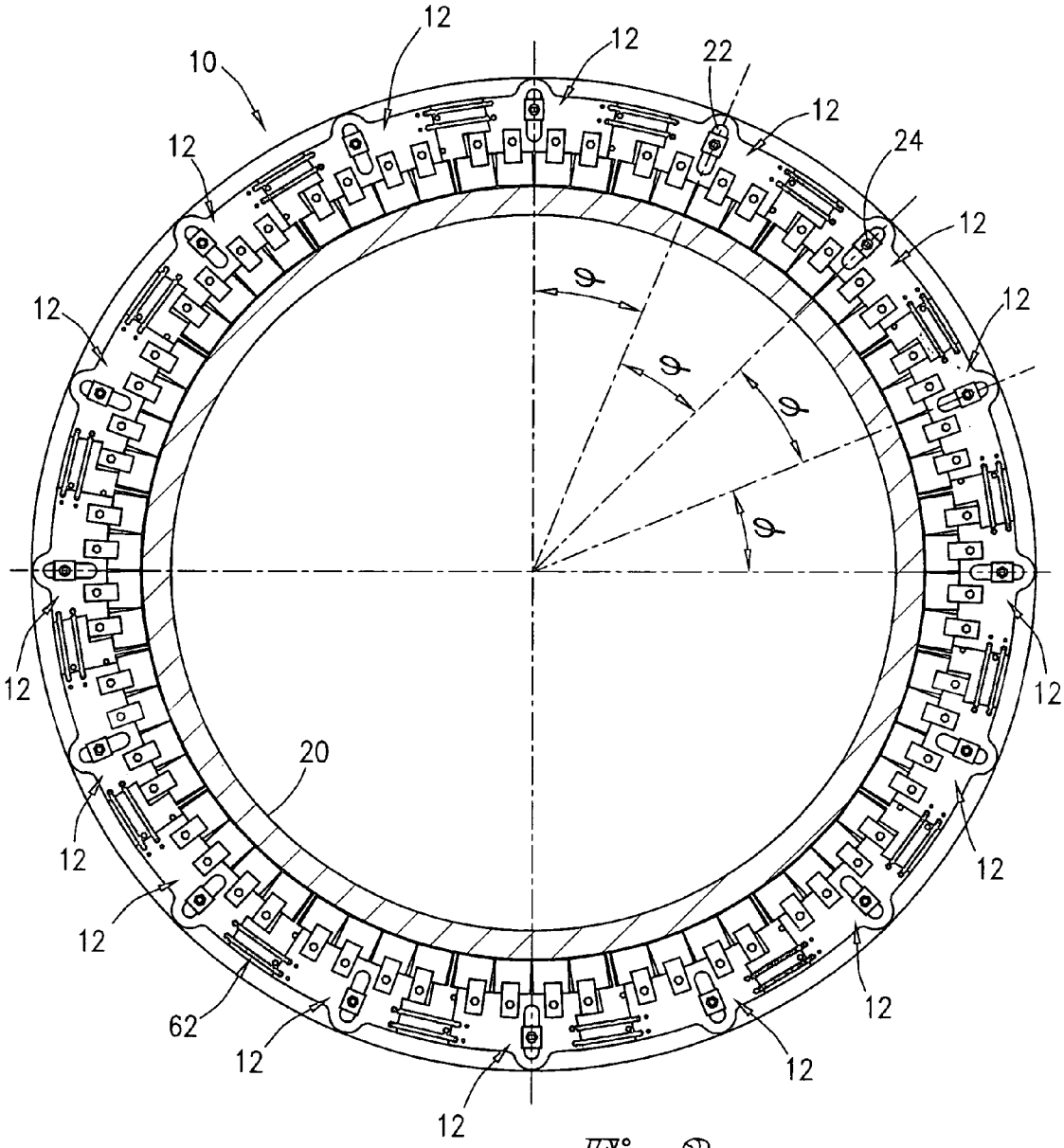
FIG. 2 is a front elevation view of the disclosed rotary seal assembly.

Each of the sixteen segment assemblies 12, seen in FIG. 2, is a radial segment "θ" of a 360-degree circle and is allowed to contract and expand relative to the outer diameter of the rotary drum 20 along slots 22 located in each segment assembly 12. Each segment assembly 12 is captured in a manner that allows the segment to be pivotal and translatable (move from one position to another) within the slot 22 relative to the fixed threaded mounting bolt, stud, or pin assembly 24. Each of the segments 12 are biased towards adjacent segments 12 by the attachment of at least one coiled tension spring 62 located adjacent each end of the segment assembly.

Figure 3:
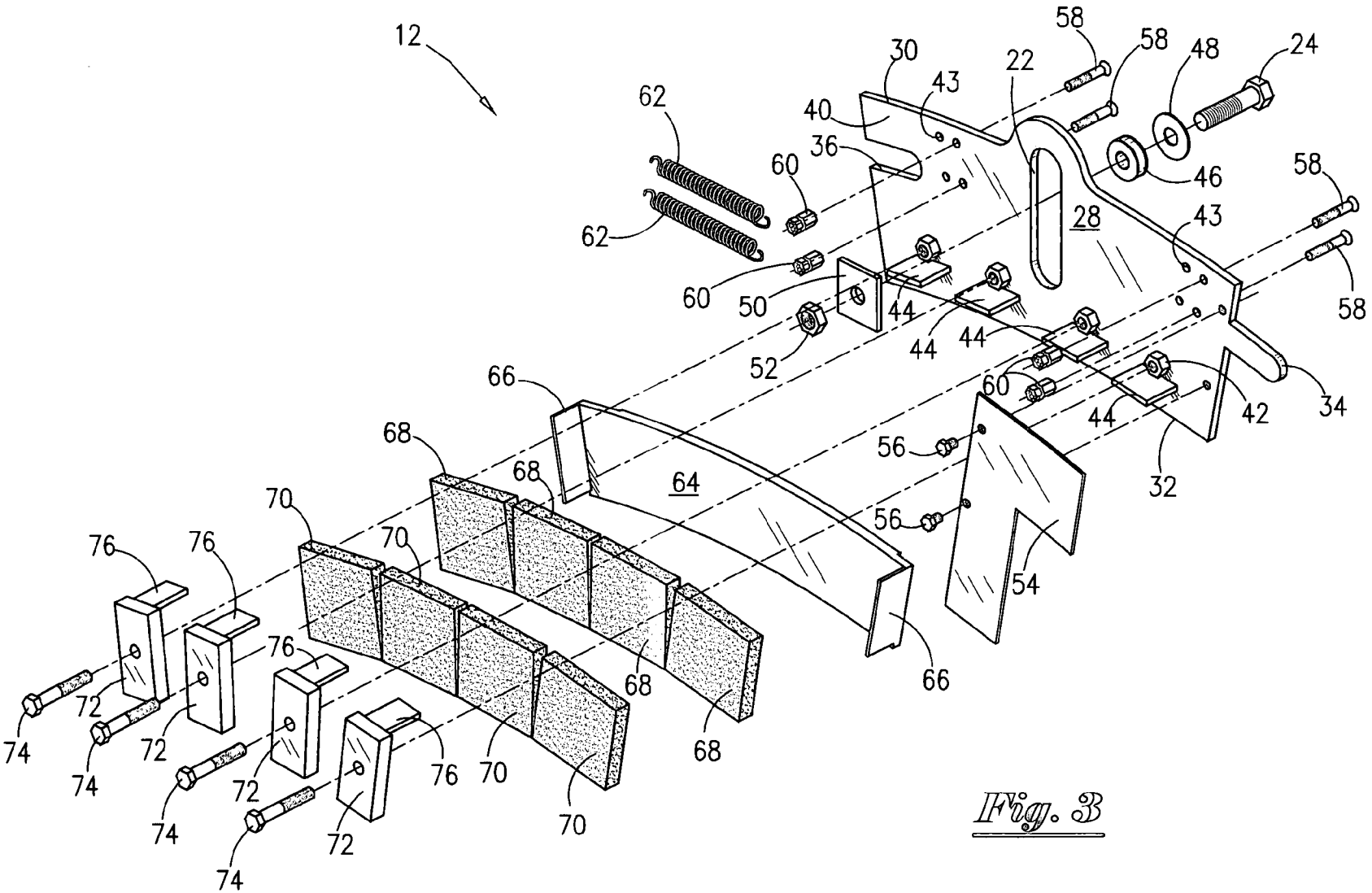
FIG. 3 is an exploded view of one segment assembly of the rotary seal assembly.
Figure 5:
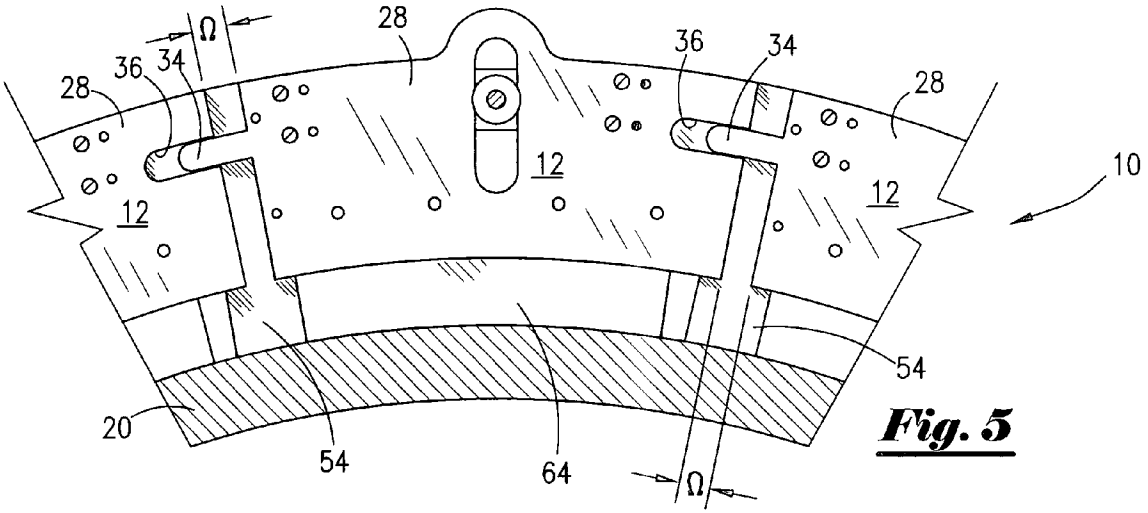
FIG. 5 is a partial rear view of the interconnected seal segments in contact with the rotary drum.

Each of the sixteen equal segment assemblies 12 shown in FIG. 2 includes the elements shown in FIG. 3. However, smaller diameter rotary drums may require fewer diametrical segments having fewer individual sealing members. In this case we have a mounting plate member 28 configured with an upper diametrical radius edge 30 and a lower diametrical radius edge 32, consistent with the radius of the rotating drum 20. Each mounting plate assembly having an elongated tang portion 34 extending outwardly from one side edge and a tang receiving slot 36 extending inwardly from the opposite side edge, with a centrally located elongated vertical bearing slot 22. The mounting plate member 28 further includes a plurality of holes 43 therein and a front face 40 to which is mounted a plurality of raised internally threaded members 42 and a plurality of stop members 44 extending outwardly in a perpendicular manner from the face 40 to prevent upward mobility of the sealing members. The mounting plate member 28 is translatable or slidable within the slot 22 and pivotally supported upon the pin or shoulder bolt 24 extending from the mounting flange 14. The mounting plates are located at radial intervals "1" on a predetermined diametrical radius. The mounting plate assembly is translatable in a manner whereby the ball or roller bearing 46 is sandwiched between two washers 48, 50 in sliding contact with each face of the mounting plate 28 so that the mounting plate is rotatable about the pin 24 and the bearing 46 within the slot 22 and retained upon the pin 24 by a nut 52. Each of the segment assemblies 12 further includes an "L" shaped gap or expansion joint cover plate 54 secured to the mounting plate 28 with screws 56 in a manner whereby the cover plate 54 covers the gap Ω between the segment's tang portion 34 and extends over the adjacent segment covering slot 36, as seen in FIG. 5. A plurality of pins or bolts 58 extends through the mounting plate 28 and thus project outwardly from the face 40 and are secured thereto with elongated nuts 60 having a pronounced external circumferential groove for the cooperative attachment of springs 62. Each of the segment assemblies 12 further includes a composition of sealing members that includes; an aluminum bar member 64 having a perpendicular retaining plate 66 at each end, a plurality of friction blocks 68 and a plurality of carbon or graphite blocks 70. The friction blocks may be arranged in rows according to type or mixed if desired. All of the sealing members should be in continuous contact with the rotary drum 20. Both the friction blocks and aluminum bar members 64 are retained in a clamped position upon the mounting plate 28 with predetermined pressure applied thereto by aluminum clamping blocks 72 and retaining bolts 74 in threaded cooperation with raised internally threaded members 42 fixed to the face 40 of the mounting plate 28. Over compression of the sealing pads and friction members 64, 68, 70 is prevented by predetermining the length of the stop or stiff legs 76 so that a holding force may be applied without damage to the graphite and brake pads, such as chipping and cracking. The aluminum bar member 64 is notched at each end on the face opposite the retaining plates 66 to prevent interference with the "L" shaped gap cover plates 54 and to allow the aluminum bar member 64 to contact the backing plate 28.

It should be understood that various materials might be used for the sealing pad members 68, 70 and in any combination. However, graphite pads or blocks 70 are preferred for one set of pads to serve as lubrication for the aluminum bar 64 and cover plates 54. However, other composites may include fibrous material such as brake pad material that may include metal and or asbestos-like fibers commonly used to withstand the high temperatures. However, such friction materials vary considerably in strength, wear characteristics, and/or density by utilizing ceramics or Kevlar fibers or other semi-metallic compounds to produce the optimum wear characteristics. Therefore, each application of the seal assembly should be evaluated to determine the best material to be used for the seal members 68 and 70.

Using the above described segmented seal assemblies 12, virtually any size rotary drum may be accommodated, thus providing a long-lasting, positive seal arrangement that allows individual sealing members or friction blocks 64, 68, 70 to be exchanged without removing the entire segment assembly 12.

Figure 4:
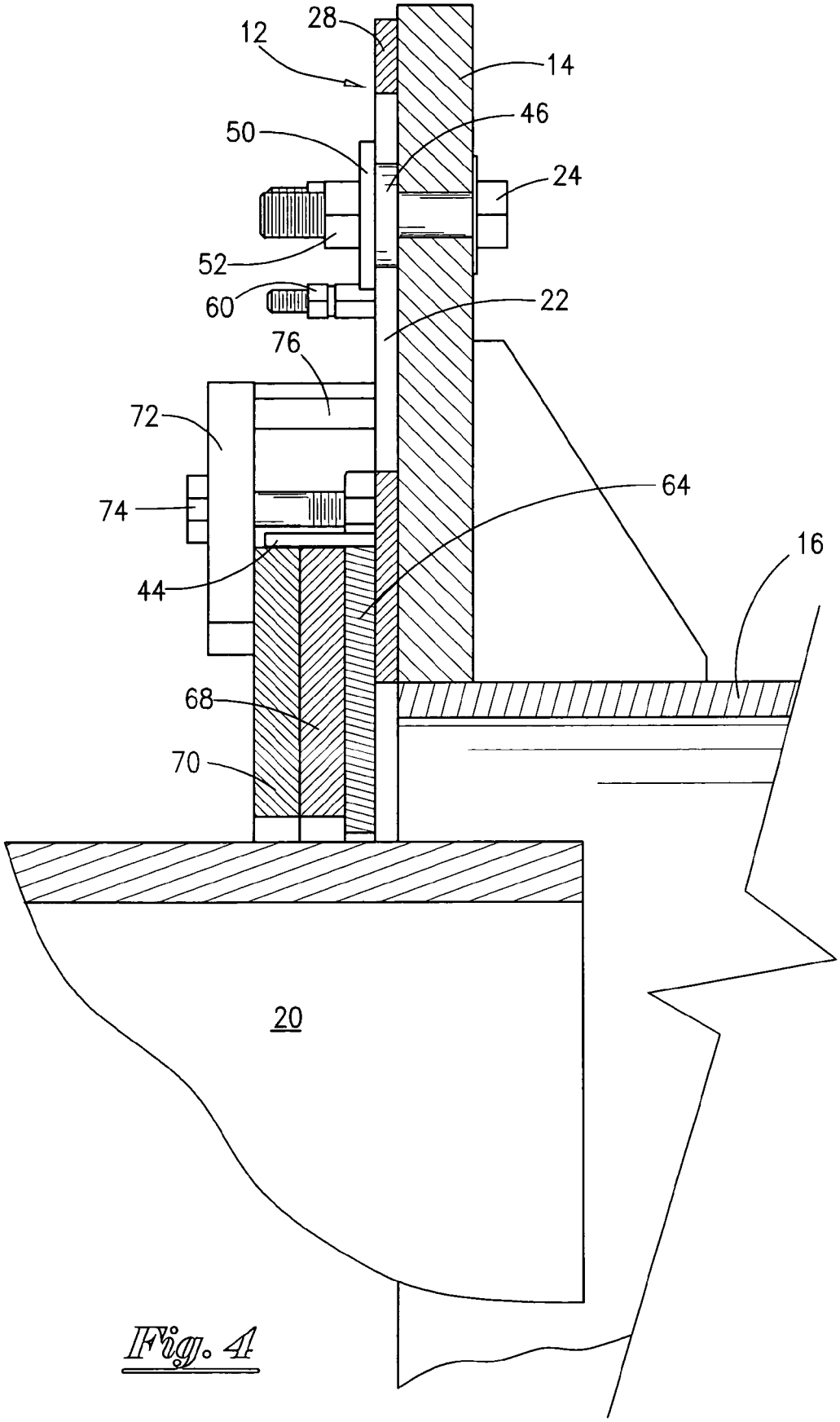
FIG. 4 is a partial cross-section view of one of the seal segments taken along sight line 4-4 as seen in FIG. 1.

As seen in cross-section in FIG. 4, the flange 14 is perpendicular to the stationary tubular 16 which projects from the in-feed hopper/exhaust stack 18. As previously mentioned above, any vertical surface encircling the rotary drum 20 may be used to support the segment assemblies 12. Utilizing the shoulder bolt mounting pins 24, the segment assemblies are positioned in a manner whereby the bearing 46 is located upon the mounting pin 24 and its brass spacer washer 48 and located slidable within the slot 22 located within the backing plate 28 and secured thereto with a square or rectangular washer 50 having a width greater than the width of the slot 22 and retained upon the mounting pin 24 with the threaded nut 52 in a manner whereby the segment assembly 12 is allowed to rotate and move up or down relative to the pin 24. It should be noted here that the aluminum bar 64 is positioned at installation so that contact is made with the rotary drum 20 and, being of lesser density than the steel rotary drum material, it is allowed to be abraded away rather rapidly and thus quickly wears to conform to the outer radii of drum 20 forming a seal prior to contact being made between the sealing pad members 68, 70. The aluminum bar 64 also serves as a heat shield for the sealing members while helping to prevent chipping of the sealing members due to vibration or horizontal movement of the rotary drum 20.

Figure 6:
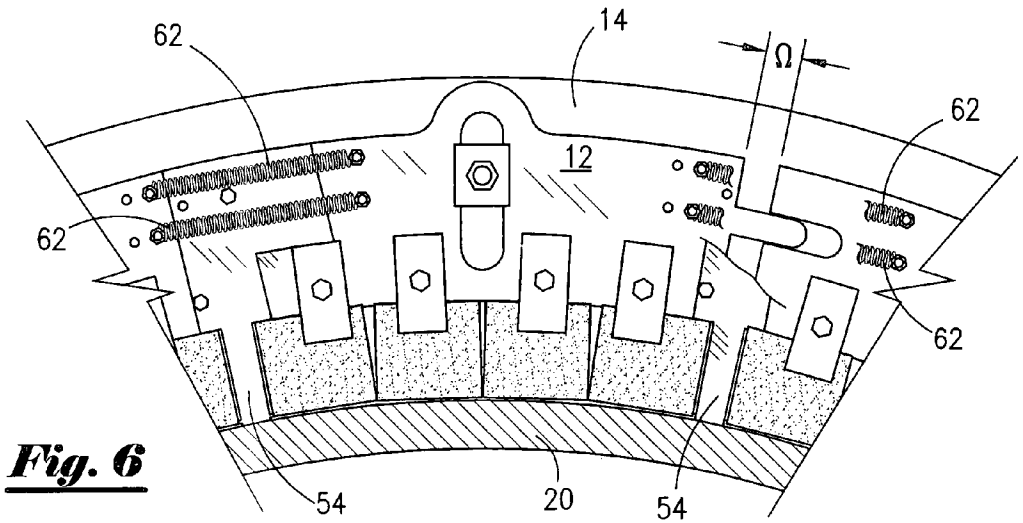
FIG. 6 is a partial front view of the interconnected seal segments in contact with the rotary drum.

Turning now to FIG. 5 and FIG. 6, we see that each segment assembly 12 is interlocked and aligned with each of the adjacent segment assemblies 12 by the tang 34 operative within the slot 36 of the adjacent segment assembly 12 in a manner whereby the segments 12 form a closed 360 degree circle seen in FIG. 2, as shown in the partial rear view of the seal assembly 10, seen in more detail in FIG. 5. As can also be seen here, the aluminum cover plates 54 provide a seal for covering the gaps "Σ" between the segments 12, thus helping to prevent heat and material from escaping the rotary drum. The cover plate 54 also makes contact with the rotary drum 20 and wears along with the sealing members 64, 68, 70. The gaps allow the segments to open or close as the sealing members 64, 68, 70 wear or conform to the shape of the rotary drum 20 during rotation.

Since rotary drum seals tend to wear on the leading edge of the direction of rotation, the interlocking tang 34 operative within the slot 36 insures that the sealing members all wear evenly.

As the rotating drum 20 rotates, contraction and expansion occur, as well as deformation of the drum due to heat and loads, thus opening and contracting the gapΣ. Looking at the front of a portion of the seal assembly 10 we see that each of the segments 12 is biased towards the adjacent segments 12 with springs 62, thereby urging the segments towards closure of the gaps Σ and thereby maintaining a constant seal. However, to reduce wear of the seal members 68, friction may be reduced by using double springs 62 to connect the lower segment assemblies 12 of the seal 10, as seen in FIG. 9, and a single spring 62 to connect segments around the upper segment assemblies 12.

Figure 7:
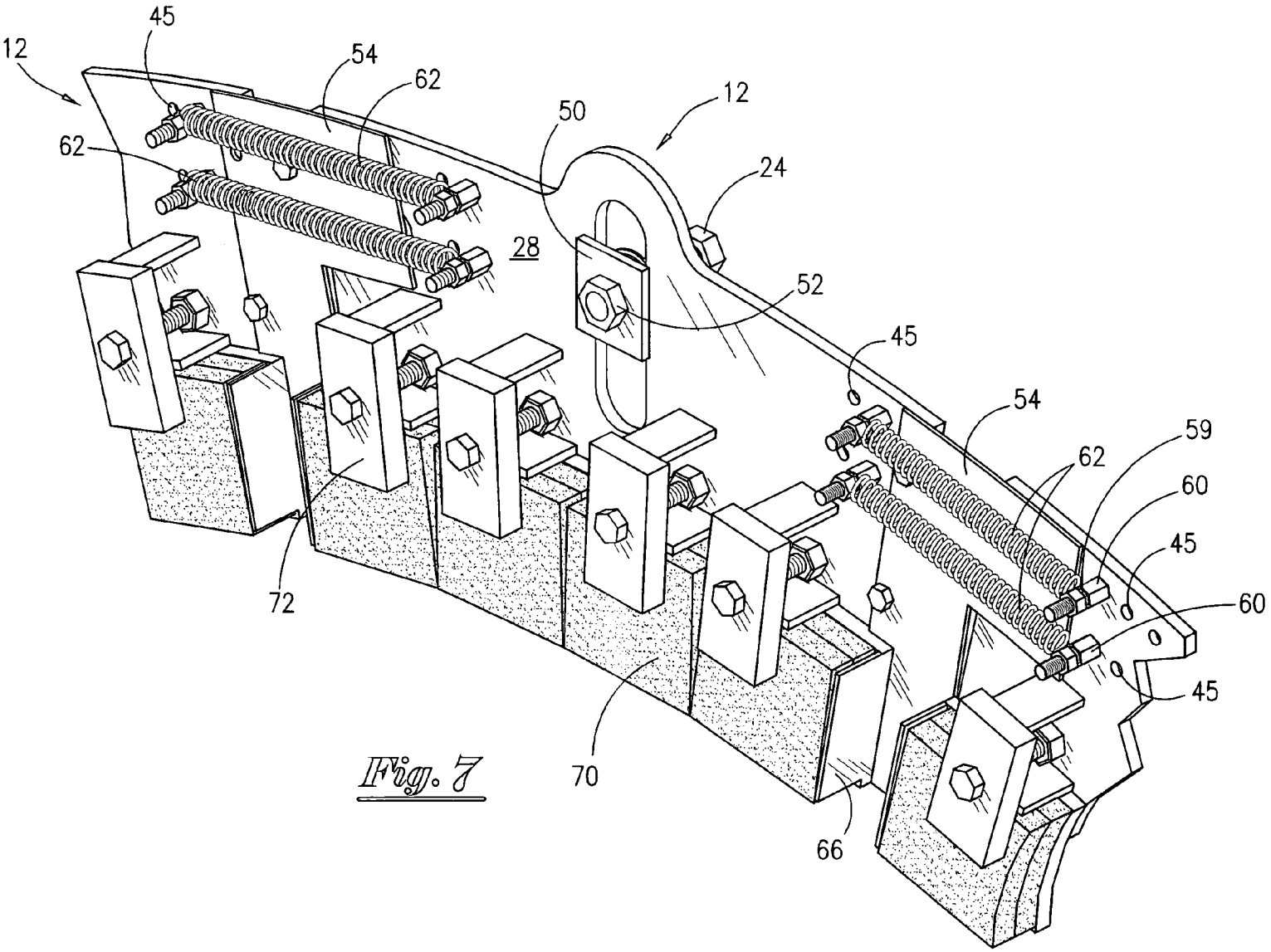
FIG. 7 is a close up partial isometric view of the interconnected seal segments.

As further seen in FIG. 7, the springs 62 spanning the gap Ω between the segments 12 and protected from high heat by the cover plates 54 are secured in position around the elongated nuts 60 by external grooves 59 threadably engaging the threaded studs or bolts 58 located adjacent each end of the backing plate 28. Tension on the springs 62 may be increased by moving one or both of the studs or bolts 58 located at each end of the spring 62 from holes 43 to expander holes 45.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A rotary kiln seal assembly comprising:

a) a plurality of independent circular ring segment assemblies forming a circle around a rotating drum, each segment pivotal and translatable about a stationary mounting pin, portions of the segment assemblies maintaining contact with the rotating drum, each said ring segment assembly further comprising:

i) a circular ring segment mounting plate having upper and lower radial edges, sides and front and rear faces;

ii) a vertical slot centrally located relative to the sides and a longitudinal slot extending inwards from one side and a tang portion extending outwards from the opposite side; a plurality of individual sealing members attached to the mounting plate comprising a metal wear bar having a circular ring segment shape with a perpendicular plate attached at each end, and a plurality of friction blocks removable clamped to the front face of the mounting plate;

iii) a plurality of elongated nuts having an external groove removably attached to the front face of the mounting plate adjacent each end;

iv) a detachable cover plate having an "L" shape attached to the front face of the mounting plate in a manner whereby a portion of the cover plate covers and extends beyond the tang portion of the mounting plate;

v) a plurality of clamping bars engaging the friction blocks having a perpendicular stop member and means for attachment to the front face of the mounting plate; and vi) a pin assembly comprising a threaded bolt, a first and second spacer, a ball bearing assembly, and a threaded nut, the bearing assembly translatable within the vertical slot; and b) a means for maintaining the segment assemblies in an interactive relationship and in self adjusting alignment relative to each other; and c) a biasing means connecting each of the segment assemblies to adjacent segment assemblies.

2. The rotary kiln seal assembly according to claim 1 wherein the alignment means is the tang portion and the longitudinal slot.

3. The rotary kiln seal assembly according to claim 1 wherein the biasing means is a plurality of coiled tension springs.

4. The rotary kiln seal assembly according to claim 1 wherein alignment between adjacent segment assemblies is maintained by the slidable engagement of the tang portion of one segment assembly within the longitudinal slot of an adjacent segment assembly.

5. The rotary kiln seal assembly according to claim 1 wherein the segment assemblies further comprise a plurality of bars attached perpendicularly to the front face.

6. The rotary kiln seal assembly according to claim 1 wherein a portion of the cover plate when attached to a segment assembly extends beyond the longitudinal slot in an adjacent segment assembly, thus covering any gap between the two segment assemblies.

7. The rotary kiln seal assembly according to claim 1 wherein the cover plate is located between the biasing means and the front face of the mounting plate.

8. The rotary kiln seal assembly according to claim 1 wherein the metal wear bar is aluminum and is notched at each end to prevent interference with the cover plate.

9. The rotary kiln seal assembly according to claim 1 wherein the bearing assembly is translatable from one position to another within the vertical slot.

10. The rotary kiln seal assembly according to claim 1 wherein the first spacer is a brass washer and the second spacer is an elongated washer having a width greater than the vertical slot.

11. The rotary kiln seal assembly according to claim 1 wherein the friction blocks are a composition of graphite.

12. The rotary kiln seal assembly according to claim 1 wherein the friction blocks are a selected brake pad composition.

13. The rotary kiln seal assembly according to claim 1 wherein the perpendicular stop member attached to the clamping members is pre-sized according to the thickness and types of the materials use for the friction blocks.

14. The rotary kiln seal assembly according to claim 1 wherein the cover plate is in contact with the rotating drum.

15. A rotary kiln seal assembly comprising:

a) a plurality of ring segment assemblies independently pivotally and translatable mounted to a stationary body and interactive with each other defining an expandable ring encircling and in frictional contact with a rotating drum each of said ring segment assemblies further comprises:

a) i) a circular ring segment mounting plate having upper and lower radial edges, sides and front and rear faces;

b) ii) a vertical slot central located relative to the sides and a longitudinal slot extending inwards from one side and a tang portion extending outwards from the opposite side;

c) iii) a plurality of individual sealing members attached to the mounting plate comprising a metal wear bar having a circular ring segment shape with a perpendicular plate attached at each end and a plurality of friction blocks located thereon;

d) iv) a plurality of elongated nuts having an external groove removably attached to the front face of the mounting plate adjacent each end.

e) v) a plurality of clamping bars engaging the friction blocks having a perpendicular stop member and means for attachment to the front face of the mounting plate; and f) vi) a pin assembly comprising a threaded bolt, a first and second spacer, a ball bearing assembly, and a threaded nut, the bearing assembly translatable within the vertical slot;

b) a plurality of biasing members connecting each of the segment assemblies to adjacent segment assemblies;

c) a plurality of sealing members clamped to each of the segment assemblies; and d) a cover plate attached to each of the segment assemblies extending over a portion of an adjacent segment assembly.

16. The rotary kiln seal assembly according to claim 15 wherein the detachable cover plate further comprises an "L" shape and is attached to the front face of the mounting plate in a manner whereby a portion of the cover plate covers and extends beyond the tang portion of the mounting plate.

17. The rotary kiln seal assembly according to claim 15 wherein the friction blocks are composites of graphite and fibrous material.

* * * * *